United States Patent [19]

Nishikawa

[11] Patent Number: 4,718,950

[45] Date of Patent: Jan. 12, 1988

[54] PROCESS FOR SELECTIVELY ANNEALING METAL STRIPS

[75] Inventor: Kiyoaki Nishikawa, Kanagawa, Japan

[73] Assignee: Nippon Mining Co., Ltd., Tokyo, Japan

[21] Appl. No.: 827,301

[22] Filed: Feb. 7, 1986

[30] Foreign Application Priority Data

Feb. 15, 1985 [JP] Japan ..... 60-26373
Feb. 15, 1985 [JP] Japan ..... 60-26374

[51] Int. Cl.[4] ..... C22F 1/00

[52] U.S. Cl. ..... 148/13.1; 148/13.2; 148/14

[58] Field of Search ..... 148/13.1, 13.2, 14, 148/19

[56] References Cited

U.S. PATENT DOCUMENTS 3,234,055 2/1966 Feng ..... 148/13.1

*Primary Examiner*—R. Dean

*Attorney, Agent, or Firm*—Seidel, Gonda, Goldhammer & Abbott

[57] ABSTRACT

A process for selectively annealing metal strips, which comprises forming a deposit in the form of a continuous or intermittent stripe or stripes of graphite powder at least 50% of which is 20 μm or less in particle diameter, on one side or both sides of a metal strip, and then heating the deposit by laser or a high-luminance light source to form a selectively annealed portion or portions. The graphite powder is one graphitized at a temperature of 3000° C. or above. The deposit is 500 μm or less in thickness. The graphite powder has a true density of 2.1 g/cm$^3$ or above. It has an average interplanar spacing between planes of the carbon hexagon of 3.60 Å or below. Its microcrystal grain diameter is 500 Å or more. In another aspect of the invention, a process for selectively annealing metal strips is provided which is characterized by the steps of forming a continuous or intermittent stripe or stripes of a deposit of graphite powder on one side or both sides of a metal strip having a mirror reflectivity of at least 20% on the surface, and then heating the deposit by a high-luminance light source to form a selectively annealed portion or portions. Here again, it is desirable to use a graphite powder having characteristics as described above.

14 Claims, No Drawings

PROCESS FOR SELECTIVELY ANNEALING METAL STRIPS

BACKGROUND OF THE INVENTION

1. Field of the Invention

This invention relates to a process for effectively performing localized, selective annealing of metal strips. More particularly, it concerns a process for selective annealing metal strips with exceptional width accuracy and a minimum of heat-affected area.

According to the present process, metals to be machined or worked to high degrees, such as spring copper alloys typified by phosphor bronze and poorly workable nickel, nickel alloys, and stainless steels, can be selectively annealed in an efficient way to soften only certain requisite portions prior to the working.

Prior Art

Metallic materials, especially spring materials, by nature rarely combine good formability with adequate springiness. Strong spring materials are difficult to form, and this has been a major limitation to the choice of configurations to which the materials are to be formed, such as of terminals, connectors, and switches.

In view of the above, it has been in practice, in fabricating strong spring materials into terminals and the like, to use special care in designing the shapes lest the materials be subject to stringent forming conditions. However, the rapid development of the electronic industry in recent years has intensified the demand for miniaturization of the terminals and other components to such an extent that there is little room now left for the consideration of shapes when the components are to be made of strong spring materials. As an attempt to solve this problem, selectively annealed materials are used in some sectors of the industry. The treatment involves annealing certain portions of metal strips to be subsequently worked under stringent conditions, such as localized drawing or twisting, or tightly closed bending. Selective annealing usually consists in partially heating a metal piece to anneal it in stripe fashion by the use of combustible gas flame, plasma arc, electron beam or the like as the heat source. However, the gas flame cannot effectively achieve the selective annealing, because it is low in energy density and difficult to attain heat concentration due to its waver. It seldom produces a selectively annealed portion with good width accuracy, homogeneity, and with only a limited heat-affected zone. The plasma arc as a heat source does not suit the purposes of the invention, either, despite its high energy density, since it calls for complex control for the stabilization of the arc. The electron beam requires a high vacuum for its functioning as a heat source. For employment in air, it would need a forbiddingly large power output. For these reasons modern practice favors the use of other heat sources, for example, in frared lamps, high-luminance light sources such as iodine and other halogen lamps, and laser. Advantages of laser and high-luminance light sources include high energy density, eminent stability, and ease of electrical output control.

Nevertheless, these new heat sources require long periods of service in achieving selective annealing of strips of metals, especially nonferrous metals and their alloys, and copper and copper-base alloys in particular. Since the rays of light from these sources are partly reflected by the metal strip surface, sufficient energy density is not attained on the surface for rapid annealing. The prolonged heating combines with the thermal conductivity of the copper alloy, for example, to disperse the heat to the surface portion of the work surrounding the objective area of selective annealing, rendering it impossible to perform selective annealing effectively.

The conventional approaches described above are not satisfactory, above all, where weight is placed on width accuracy or where a selectively annealed portion with a minimum of the heat-affected zone is to be obtained. Even if the rays of light from a given source were brought to focus, for example through a plane, ellipsoidal, or parabolic mirror or a condenser, or through a plurality of such mirrors or lenses, upon a work portion to be selectively annealed, they would not still produce an adequate energy density on the surface of the metal strip. Thus, heating for a great length of time is required for selective annealing. The extended heating and the high thermal conductivity of the copper alloy cause the dispersion of heat from the specific portion to be selectively annealed. Consequently, it is impossible to obtain a selectively annealed portion with excellent width accuracy and a minimum of the heat-affected zone. Furthermore, focusing the entire rays of light from such a source upon the intended portion for selective annealing is impractical; it necessarily heats the work area around the portion being selectively annealed. This results in poor dimensional accuracy of the selectively annealed portion. In order to overcome this difficulty, it has been tried to provide a diaphragm to eliminate the scatter of light by which the work surface area surrounding the portion to be selectively annealed would be undesirably heated. Alternatively, the use of a mask has been proposed to expose only the portion to be selectively annealed to the light source and prevent unwanted heating of the surrounding area. However, the former eliminates part of the light rays intended for heating the portion to be selectively annealed, making prolonged heating inevitable. The latter, or masking, involves difficulties in exactly mounting the mask in position to shield the portion other than that for selective annealing. Therefore, no selectively annealed portion with high width accuracy or a limited heat-affected zone can be obtained.

OBJECTS OF THE INVENTION

It is an object of the present invention to provide a process for effectively performing the selective annealing of metal strips without the disadvantages of the prior art described above.

Another object of the invention is to provide a process for obtaining material strips with selectively annealed portions excellent in width accuracy and limited in the heat-affected zone, without the foregoing disadvantages of the prior art.

SUMMARY OF THE INVENTION

After our studies on the way of focusing light energy in selective annealing of metal strips, a process has now been perfected which is characterized by the steps of forming a continuous or intermittent stripe or stripes of a deposit of graphite powder at least 50% of which is 20 μm or less in particle diameter, on one side or both sides of a metal strip, and then heating the deposit by laser or a high-luminance light source to form a selectively annealed portion or portions. It has also been found that the deposit of the graphite powder is desired to satisfy the characteristic requirement or condition that (1) the powder be obtained by graphitizing at a temperature above 3000° C., (2) the deposit have a thickness of 500 μm or less, and (3) the deposit consist of powder graphitized at a temperature above 3000° C. and 500 μm or less in thickness.

Even better result is obtained by employing, for the selective annealing purpose, a graphite powder with a true density of 2.1 g/cm$^3$ or above, graphite powder with an average interplanar spacing between planes of the carbon hexagon of 3.60 Å or below, graphite powder with microcrystal grain diameters of 500 Å or above, or a combination of these.

In another aspect of the invention, a process for selective annealing metal strips is provided which is characterized by the steps of forming a continuous or intermittent stripe or stripes of a deposit of graphite powder on one side or both sides of a metal strip having a mirror reflectivity of at least 20% on the surface, and then heating the deposit by a high-luminance light source to form a selectively annealed portion or portions. Here again, it is desirable to use a graphite powder (1) graphiteized at a temperature above 3000° C., (2) deposited 500 μm or less thick, or (3) graphitized at a temperature above 3000° C. and deposited 500 μm or less thick.

DETAILED DESCRIPTION OF THE INVENTION

In the first aspect of the invention, a deposit of graphite powder which scarcely reflects light and readily absorbs heat is formed on a portion or portions of a metal strip to be selectively annealed, thereby to render the portion or portions more heat-absorptive for faster heating to achieve selective annealing of the metal strip.

Under the invention the graphite powder to be used is such that at least 50% of it is composed of particles 20 μm or less in particle diameter. If a deposit is formed of a graphite powder of which less than 50% is constituted by the particles finer than 20 μm, the deposit will have too many interstices between the particles to transfer the heat absorbed at the surface rapidly to the underlying surface of the metal strip. The slow heat transfer is not desirable for the formation of a sound selectively annealed portion.

In a preferred embodiment of the invention a graphite powder graphitized at a temperature above 3000° C. is used. A deposit formed of such a powder is improved in thermal conductivity, more than several fold, over the deposit of a powder graphitized below 3000° C., and hence is faster to be selectively annealed. The thickness of the graphite powder deposit is limited to 500 μm or below in accordance with the invention. This is because, for the rapid transfer of the absorbed heat from the graphite surface to the metal surface, the thickness of the deposit should be minimized, and 500 μm or less gives a favorable result. In addition, the graphite powder is specified to have a true density of at least 2.1 g/cm$^3$, because the less void space with in the particles themselves, the better will be the thermal conductivity of the graphite powder deposit, and the easier will be the attainment of rapid heating necessary for selective annealing. The average interplanar spacing between planes of the carbon hexagon should be 3.60 Å or below for the following reason. The rate of heat conduction in the direction perpendicular to a given plane of the carbon hexagon is only several tenths of the rate in the direction parallel to the plane. Thus, the shorter the average interplanar spacing between planes of the carbon hexagon the higher the thermal conductivity and the greater the efficiency of selective annealing. Hence the interplanar spacing of 3.60 Å or below is desirable. Further, according to the invention, the lower limit of 500 Å is chosen for the diameters of microcrystal grains in the graphite powder on the following ground. As stated above, the rate of heat conduction in the direction parallel to a given plane of the carbon hexagon is several ten times higher than the rate in the direction perpendidular to the plane. This characteristic is more pronounced and more readily utilizable as the carbon hexagon chain extends. With microcrystal grain diameters of 500 Å or more, the above charactaristic is fully taken advantage of in attaining a marked improvement of thermal conduction through the deposit.

According to the second aspect of the invention, a deposit of graphite powder that scarcely reflects light and is highly heat-absorptive is formed on a work portion to be selectively annealed, and, by contrast, the light reflectivity of the metal strip surface region around the portion to be annealed and which is necessarily exposed to the high-luminance light source at the time of selective annealing is much enhanced. As a consequence, the heat absorption capacity of the region around the portion to be irradiated with the rays of light from the above source for selective annealing is kept very low, whereas the heat absorption capacity of the portion to be annealed is markedly increased for rapid heating and selective annealing of the particular portion of the metal strip. The mirror reflectivity of the metal strip surface is specified to be at least 20%, because with a reflectivity of less than 20% the metal surface would fail to attain the adequate reflection for the purpose of the invention upon exposure to light from the above source.

As stated above, the deposit of graphite powder is specified to be 500 μm or less in thickness, because the heat absorbed by the graphite deposit surface is more rapidly transferred to the underlying metal surface when a thinner deposit is used and the thickness of 500 μm or below gives favorable result. Further, the deposit is formed of graphite powder graphitized at a temperature above 3000° C., because the deposit attains a thermal conductivity more than several times greater than that of a deposit of powder graphitized below 3000° C. and the former is much easier to form a selectively annealed portion.

In the practice of the invention, a plane, ellipsoidal, or parabolic mirror or a condenser may be employed singly or in a set to bring the rays of light from an infrared lamp, iodine or other halogen lamp, or other high-luminance light source to focus upon and heat a work portion to be selectively annealed. Also, it is not in the least objectionable to combine such focusing means with a mask plate having a slit or slites broader than the width of the focused light.

Water-cooled jigs for cooling the metal strip along the both edges of the locally annealed portion or jigs for forcibly air-cooling the strip may be installed on one side or both sides of the strip to attain an enhanced cooling effect. Needless to say, any discoloration of the work during the heating can be avoided by using an inert gas, such as argon or nitrogen gas, with or without partial replacement by hydrogen gas, in place of air for forced cooling. The effect will be all the more beneficial if the afore-mentioned mask plate and cooling jigs are combined or if jigs combining the both functions are employed.

The stripe(s) according to this invention may be formed along the length of a metal strip or otherwise may be formed transversely of the length of the strip.

EXAMPLE 1

On phosphor bronze strips, 0.4 mm thick and having a composition of 7.9% tin, 0.15% phosphorus, and the remainder copper, were formed deposits of graphite powders in different conditions shown in Table 1, in stripes 4 mm wide. Each deposit was heated by infrared rays focused to a 4 mm-wide beam by an ellipsoidal mirror to form a selectively annealed portion. The selectively annealed condition was evaluated by determining the width of the heat-affected zone through measurements of the time (annealing time) required for the attainment of hardness (μHv 200 g) of 140 or below throughout the entire width of the 4 mm-wide selectively annealed portion and the hardness distribution at that point of time. The results are given in Table 2. It will be seen from Table 2 that the process of the invention affords selectively annealed portions with narrower heat-affected zones within shorter time periods than by the conventional method. The process of the invention is therefore most suited for selective annealing of metal strips.

TABLE 1

| | Percentage of graphite less than 20 μm in particle diameter (%) | Graphitizing temperature (°C.) | True density (g/cm³) | Average interplanar spacing between planes of carbon hex. (Å) | Microcrystal grain diameter (Å) | Thickness of deposit (μm) |
|---|---|---|---|---|---|---|
| Example 1 | 60 | 2300 | 1.72 | 3.70 | 300 | 600 |
| Example 2 | 70 | 2700 | 1.80 | 3.80 | 400 | 400 |
| Example 3 | 50 | 3000 | 1.90 | 3.81 | 400 | 700 |
| Example 4 | 80 | 3300 | 1.86 | 3.74 | 200 | 300 |
| Example 5 | 70 | 2800 | 1.75 | 3.92 | 300 | 400 |
| Example 6 | 60 | 2500 | 1.90 | 3.70 | 400 | 300 |
| Example 7 | 70 | 3100 | 1.95 | 3.68 | 200 | 200 |
| Example 8 | 70 | 3000 | 2.00 | 3.65 | 300 | 200 |
| Example 9 | 80 | 3000 | 2.20 | 3.70 | 300 | 200 |
| Example 10 | 70 | 3000 | 2.15 | 3.70 | 400 | 300 |
| Example 11 | 90 | 3300 | 2.24 | 3.42 | 400 | 200 |
| Example 12 | 90 | 3000 | 2.19 | 3.50 | 400 | 300 |
| Example 13 | 80 | 3200 | 2.22 | 3.48 | 1500 | 200 |
| Example 14 | 90 | 3000 | 2.20 | 3.51 | 1000 | 200 |
| Comp. Ex. 1 | 40 | 2500 | <2.10 | 3.60< | <500 | 800 |
| Comp. Ex. 2 | 30 | 2700 | <2.10 | 3.60< | <500 | 700 |
| Comp. Ex. 3 | 30 | 2300 | <2.10 | 3.60< | <500 | 600 |
| Comp. Ex. 4 | | | No deposit | | | |

TABLE 2

| | Annealing time (sec) | Width of heat affected zone (mm) |
|---|---|---|
| Example 1 | 52 | 3.5 |
| Example 2 | 47 | 3.3 |
| Example 3 | 47 | 3.3 |
| Example 4 | 43 | 3.0 |
| Example 5 | 40 | 2.8 |
| Example 6 | 37 | 2.0 |
| Example 7 | 35 | 2.3 |
| Example 8 | 33 | 2.0 |
| Example 9 | 26 | 1.6 |
| Example 10 | 29 | 1.9 |
| Example 11 | 22 | 1.2 |
| Example 12 | 25 | 1.5 |
| Example 13 | 17 | 1.0 |
| Example 14 | 20 | 1.0 |
| Comp. Ex. 1 | 68 | 8.5 |

TABLE 2-continued

| | Annealing time (sec) | Width of heat affected zone (mm) |
|---|---|---|
| Comp. Ex. 2 | 65 | 8.0 |
| Comp. Ex. 3 | 60 | 9.4 |
| Comp. Ex. 4 | 83 | 19.4 |

EXAMPLE 2

Phosphor bronze strips, having 0.4 mm thickness and a composition of 7.9% tin, 0.15% phosphorus, and the remainder cooper, were polished on the surface to different mirror reflectivity values given in Table 3. Graphite powders, graphitized at different temperatures shown in Table 3 were applied to the metal pieces to form 4 mm-wide deposits of varying thicknesses as shown in Table 3. Each deposit was heated by infrared rays focused by an ellipsoidal mirror to a 4 mm-wide beam so as to form a selectively annealed portion. The conditions of these selectively annealed portions were evaluated by determining the hardness distribution and measuring the widths of the individual annealed portions and heat-affected zones. The results are summarized in Table 4. It will be understood from Table 4 that the process of the invention gives selectively annealed portions better in width accuracy and less in the area of the heat-affected zone than those obtained conventionally.

TABLE 3

| | Mirror reflectivity (%) | Thickness of deposit (μm) | Graphitizing temperature (°0) |
|---|---|---|---|
| Example 1 | 35 | 600 | 2500 |
| Example 2 | 58 | 800 | 2300 |
| Example 3 | 62 | 700 | 2700 |
| Example 4 | 43 | 200 | 2500 |
| Example 5 | 75 | 100 | 2600 |
| Example 6 | 51 | 400 | 2900 |
| Example 7 | 33 | 600 | 3000 |
| Example 8 | 59 | 700 | 3500 |
| Example 9 | 72 | 900 | 3300 |
| Example 10 | 41 | 200 | 3200 |
| Example 11 | 67 | 100 | 3600 |
| Example 12 | 73 | 300 | 3800 |

TABLE 3-continued

| | Mirror reflectivity (%) | Thickness of deposit (μm) | Graphitizing temperature (°0) |
|---|---|---|---|
| Comp. Ex. 1 | 13 | 0 | — |
| Comp. Ex. 2 | 15 | 0 | — |
| Comp. Ex. 3 | 17 | 0 | — |

TABLE 4

| | Width of selectively annealed portion (mm) | Width of heat-affected zone (mm) |
|---|---|---|
| Example 1 | 4.8 | 2.0 |
| Example 2 | 4.9 | 2.3 |
| Example 3 | 4.7 | 2.0 |
| Example 4 | 4.3 | 1.6 |
| Example 5 | 4.2 | 1.5 |
| Example 6 | 4.5 | 1.7 |
| Example 7 | 4.3 | 1.5 |
| Example 8 | 4.4 | 1.4 |
| Example 9 | 4.6 | 1.8 |
| Example 10 | 4.0 | 1.0 |
| Example 11 | 4.0 | 0.8 |
| Example 12 | 4.0 | 1.0 |
| Comp. Ex. 1 | 8.3 | 8.0 |
| Comp. Ex. 2 | 9.2 | 8.5 |
| Comp. Ex. 3 | 9.5 | 9.4 |

What is claimed is:

1. A process for selective annealing metal strips, which comprises forming a deposit in the form of a continuous or intermittent stripe or stripes of graphite powder at least 50% of which is 20 μm or less in particle diameter, on one side or both sides of a metal strip, and then heating the deposit by laser or a high-luminance light source to form a selectively annealed portion or portions.

2. A process for selective annealing metal strips, which comprises forming a deposit in the form of a continuous or intermittent stripe or stripes of graphite powder graphitized at a temperature of 3000° C. or above and at least 50% of which is 20 μm or less in particle diameter, on one side or both sides of a metal strip, and then heating the deposit by laser or a high-luminance light source to form a selectively annealed portion or portions.

3. A process for selective annealing metal strips, which comprises forming a deposit 500 μm or less in thickness in the form of a continuous or intermittent stripe or stripes of graphite powder at least 50% of which is 20 μm or less in particle diameter, on one side or both sides of a metal strip, and then heating the deposit by laser or a high-luminance light source to form a selectively annealed portion or portions.

4. A process for selective annealing metal strips, which comprises forming a deposit 500 μm or less in thickness in the form of a continuous or intermittent stripe or stripes of graphite powder graphitized at a temperature of 3000° C. or above and at least 50% of which is 20 μm or less in particle diameter, on one side or both sides of a metal strip, and then heating the deposit by laser or a high-luminance light source to form a selectively annealed portion or portions.

5. A process according to any of claims 1 to 4 wherein the graphite powder has a true density of 2.1 g/cm$^3$ or above.

6. A process according to any of claims 1 to 4 wherein the graphite powder has an average interplanar spacing between planes of the carbon hexagon of 3.60 Å or below.

7. A process according to any of claim 5 wherein the graphite powder has an average interplanar spacing between planes of the carbon hexagon of 3.60 Å or below.

8. A process according to any of claim 1 to 4 wherein the graphite powder has microcrystal grain diameters of 500 Å or more.

9. A process according to claim 5 wherein the graphite powder has microcrystal grain diameters of 500 Å or more.

10. A process according to claim 6 wherein the graphite powder has microcrystal grain diameters of 500 Å or more.

11. A process for selectively annealing metal strips, which comprises forming a deposit in the form of a continuous or intermittent stripe or stripes of graphite powder, on one side or both sides of a metal strip having a mirror reflectivity of at least 20% on the surface, and then heating the deposit by a high-luminance light source to form a selectively annealed portion or portions.

12. A process for selective annealing metal strips, which comprises forming a deposit in the form of a continuous or intermittent stripe or stripes of graphite powder graphitized at a temperature of 3000° C. or above, on one side or both sides of a metal strip having a mirror reflectivity of at least 20% on the surface, and then heating the deposit by a high-luminance light source to form a selectively annealed portion or portions.

13. A process for selectively annealing metal strips, which comprises forming a deposit 500 μm or less in thickness in the form of a continuous or intermittent stripe or stripes of graphite powder, on one side or both sides of a metal strip having a mirror reflectivity of a least 20% on the surface, and then heating the deposit by a high-luminance light source to form a selectively annealed portion or portions.

14. A process for selectively annealing metal strips, which comprises forming a deposit 500 μm or less in thickness in the form of a continuous or intermittent stripe or stripes of graphite powder graphitized at a temperature of 3000° C. or above, on one side or both sides of a metal strip having a mirror reflectivity of at least 20% on the surface, and then heating the deposit by a high-luminance light source to form a selectively annealed portion or portions.

* * * * *